US006102123A

United States Patent [19]

Bailey et al.

[11] Patent Number: 6,102,123

[45] Date of Patent: Aug. 15, 2000

[54] ONE TRIP MILLING SYSTEM

[75] Inventors: Thomas F. Bailey, Houston; Bruce D. Swearingen, The Woodlands, both of Tex.

[73] Assignee: Smith International, Inc.

[21] Appl. No.: 09/021,630

[22] Filed: Feb. 10, 1998

Related U.S. Application Data

[63] Continuation-in-part of application No. 08/642,829, May 3, 1996, Pat. No. 5,771,972, and a continuation-in-part of application No. 08/642,824, May 3, 1996, Pat. No. 5,816,324.

[51] Int. Cl.[7] ..... E21B 43/00

[52] U.S. Cl. ..... 166/313; 166/50; 166/117.6; 166/242.5; 175/80

[58] Field of Search ..... 166/50, 117.5, 166/117.6, 242.2, 242.5, 313; 175/61, 62, 80, 81

[56] References Cited

U.S. PATENT DOCUMENTS

| | | | |
|---|---|---|---|
| 2,216,963 | 10/1940 | Sinclair | 255/1 |
| 4,182,423 | 1/1980 | Ziebarth et al. | 175/61 |
| 4,397,360 | 8/1983 | Schmidt | 175/61 |
| 4,765,404 | 8/1988 | Bailey et al. | 166/177.6 |
| 5,109,924 | 5/1992 | Jürgens et al. | 166/117.5 |
| 5,445,222 | 8/1995 | Pritchard et al. | 166/298 |
| 5,484,021 | 1/1996 | Hailey | 166/297 |
| 5,551,509 | 9/1996 | Braddick | 166/55.7 |
| 5,592,991 | 1/1997 | Lembcke et al. | 166/298 |
| 5,657,820 | 8/1997 | Bailey et al. | 175/80 X |

FOREIGN PATENT DOCUMENTS 2303158 12/1997 United Kingdom .

OTHER PUBLICATIONS

A–Z Grant International; *Casing Sidetrack Systems*; undated; (7 pgs.).

*Track Master Sidetracking System*; Feb. 24, 1995; (1 sheet).

*Primary Examiner*—Roger Schoeppel

*Attorney, Agent, or Firm*—Conley, Rose & Tayon, P.C.

[57] ABSTRACT

The milling and whipstock assembly includes a whipstock having a ramp portion for directing the milling assembly to cut a secondary borehole in an existing cased borehole. The milling assembly includes a shaft having rigid and flexible portions and an under gauge cutting tool disposed on the lower end of the flexible portion and a full gauge cutting tool disposed on the rigid portion. A third under gauge cutting tool is disposed on the flexible portion in between the full gauge and under gauge cutting tools. In operation, the milling and whipstock assembly is lowered into the borehole and then the milling assembly is detached from the whipstock assembly. As weight is placed on the milling assembly, the ramp portion places a side load on the lower under gauge cutting tool causing the flexible portion of the shaft to flex and pivot allowing the under gauge cutting tool to come into engagement with the wall of the casing allowing the under gauge cutting tools to cut a window in the cased borehole.

11 Claims, 3 Drawing Sheets

ONE TRIP MILLING SYSTEM

CROSS REFERENCE TO RELATED APPLICATIONS

This application is a continuation-in-part of U.S. patent application Ser. No. 08/642,829, filed May 3, 1996, now U.S. Pat. No. 5,771,972 and Ser. No. 08/642,824 filed May 3, 1996, now U.S. Pat. No. 5,816,324, both hereby incorporated herein by reference and relates to a patent application entitled Two Trip Window Cutting system, Ser. No. 572,592, filed Feb. 14, 1995, now U.S. Pat. No. 5,657,820, hereby incorporated herein by reference.

BACKGROUND OF THE INVENTION

The present invention relates to a method and apparatus for drilling a secondary borehole from an existing borehole in a formation and more particularly to an improved milling and whipstock assembly for drilling a deviated borehole from an existing earth borehole or for side tracking through a cased borehole.

Whipstocks are known to have been used to drill a deviated borehole from an existing earth borehole. The whipstock has a ramp surface which is set in a predetermined position to guide the drill bit on the drill string in a deviated manner to drill into the side of the earth borehole. In operation, the whipstock is set in the existing earth borehole, the set position of the whipstock is surveyed, the whipstock is properly oriented for directing the drill string in the proper direction, and the drilling string is lowered into the well into engagement with the whipstock causing the whipstock to orient the drill string to drill a deviated borehole into the wall of the existing earth borehole.

Whipstocks are also known to be used for side tracking through a cased borehole. Previously drilled and cased boreholes, for one reason or another, may become nonproductive. When a wellbore becomes unusable, a new borehole may be drilled in the vicinity of the existing cased borehole or alternatively, a new borehole may be side tracked from or near the bottom of a serviceable portion of the cased borehole. Side tracking from a cased borehole may also be used for developing and drilling multiple production zones. Side tracking is often preferred because it avoids the additional drilling, casing and cementing of the borehole. The procedure for side tracking is generally accomplished by either milling out an entire section of casing followed by drilling through the side of the now exposed borehole or by milling through the side of the casing with one or more mills that are guided by a wedge or whipstock component.

Drilling a side tracked borehole through a cased borehole made of steel is difficult and often results in unsuccessful penetration of the casing and destruction of the whipstock. In addition, if the window is improperly cut, a severely deviated dog leg may result rendering the side tracking operation unusable. Patents which relate to methods and apparatus for sidetracking through a cased borehole include U.S. Pat. Nos. 4,266,621 and 4,397,355.

It is further preferred to perform the side tracking operation with one trip into the borehole. Such a one trip includes lowering the mills and whipstock into the borehole at the proper location, orienting the whipstock in the proper direction for cutting the cased borehole, setting and supporting the whipstock within the cased borehole, and milling the cased borehole to form a window in the casing.

U.S. Pat. No. 5,109,924 teaches a one trip window cutting operation for side tracking a cased borehole. A deflection wedge guide is positioned behind the pilot mill cutter and spaced from the end of the whipstock. The shaft of the mill cutter is retained against the deflection wedge guide such that the milling tool frontal cutting surface does not come into contact with the ramped base of the whipstock. In theory, the deflection wedge guide surface takes over the guidance of the window cutting tool without the angled ramp surface of the whipstock being destroyed. However, when a second and third milling tool attached to the same shaft as the window milling cutter and spaced, one from the other on the support shaft contacts the whipstock ramp surface, they mill away the deflection guide projection from the ramp surface. This inhibits or interferes with the leading pilot mill window cutter from side tracking at a proper angle with respect to the axis of the cased borehole and may cause the pilot window cutting mill to contact the ramp surface of the whipstock before the pilot window cutter mill clears the casing. The reamers or mills aligned behind the pilot window mill, having the same or larger diameter as the pilot window mill, prevents or at least inhibits the window pilot mill from easily exiting from the steel casing. This difficulty is due to the lack of clearance space and flexibility of the drill pipe assembly making up the one trip window cutting tool when each of the commonly supported reamer mills spaced along the shaft, sequentially contact the window in the steel casing. Hence, the side tracking apparatus tends to go straight rather than be properly angled through the steel casing.

U.S. Pat. No. 5,455,222 discloses a combination whipstock and staged side tracked mill. A pilot mill spaced from and located on the common shaft above a tapered cutting end is, at its largest diameter, between 50% and 75% of the final side track window diameter. A surface of a second stage cutter positioned on the same shaft above the pilot mill being, at its smallest diameter, about the diameter of the maximum diameter of the pilot mill, and being, at its largest diameter, at least 5% greater in diameter than the largest diameter of the pilot mill. A surface of a final stage cutter mill, also mounted on the same shalt, being at its largest diameter, about the final diameter dimension, and at the smallest cutting surface diameter, being a diameter of at least about 5% smaller than the final diameter dimension. The side tracking mill is designed to accomplish the milling operation in one trip. However, the mill tends to go straight and penetrates the ramp surface of the whipstock causing substantial damage to the whipstock occurs and preventing side tracking from occurring.

While it is intended that the prior art side tracking operations be performed in one trip, difficulties often arise when attempting to deviate the drill string from its original path to an off line side tracking path. Progressively larger in diameter reaming stages to enlarge the window in the steel casing inhibits the drill shaft from deviating or flexing sufficiently to direct the drill pipe in a proper direction resulting in damage to the whipstock and misdirected side track boreholes. In other words, the side tracking assembly tends to go straight rather than deviating through the steel casing.

The present invention overcomes the deficiencies of the prior art.

SUMMARY OF THE INVENTION

The present invention includes a milling and whipstock assembly for cutting a secondary borehole in an existing borehole. The whipstock assembly includes a whipstock having a ramp portion for directing the milling assembly to cut the secondary borehole. The milling assembly includes a shaft having a rigid portion and a flexible portion with an under gauge cutting tool disposed on the lower end of the flexible portion of the shaft and a full gauge cutting tool disposed on the rigid portion. Typically, a third under gauge cutting tool is also disposed on the flexible portion in between the full gauge and under gauge cutting tools. Initially, the milling assembly is attached to the whipstock assembly by means of a shear member connecting the lower under gauge cutting tool to the upper end of the whipstock.

In operation, the shear member is sheared separating or detaching the milling assembly from the whipstock assembly allowing the milling assembly to be lowered into the borehole. As weight is placed on the milling assembly, the ramp portion of the whipstock places a side load on the lower under gauge cutting tool causing the flexible portion to flex into engagement with the wall of the casing. As the flexible portion flexes, the shaft pivots below the full gauge cutting tool since the full gauge cutting tool is substantially the same size as the bore of the casing. The under gauge cutting tools then cuttingly engage the wall of the casing to cut a window in the cased borehole.

Other objects and advantages of the invention will appear from the following description.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENT

Figure 1:
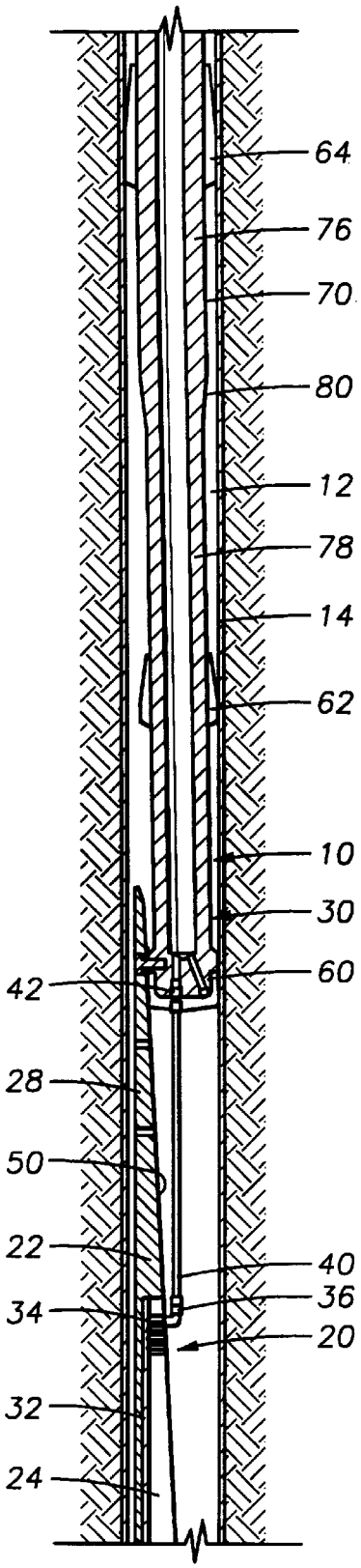
FIG. 1 is a partial cross-sectional elevation view of the milling and whipstock assembly of the present invention properly located within a cased borehole.
Figure 2:
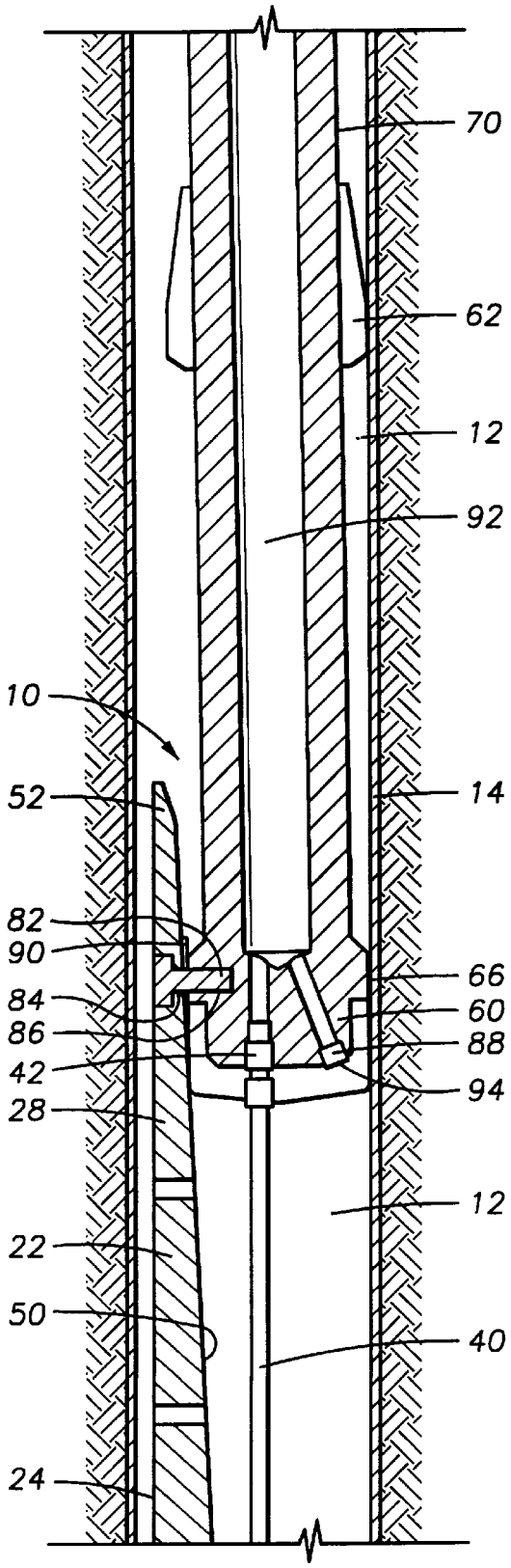
FIG. 2 is an enlarged cross-sectional view of the window mill and upper end of the whipstock shown in FIG. 1.

Referring initially to FIGS. 1 and 2, there is shown a one-trip milling and whipstock assembly 10 disposed within the original borehole 12 formed by a string of casing 14 cemented within the well. The purpose of the milling and whipstock assembly 10 is to drill or mill a pilot or window through the wall of casing 14 for drilling one or more new secondary or deflection boreholes 16, best shown in FIG. 6, through original borehole 12. The one-trip milling and whipstock assembly 10 includes a whipstock assembly 20 and a milling assembly 30.

The whipstock assembly 20 includes a whipstock 22 and an anchor-packer (not shown) connected to the lower end of whipstock 22 by a connector sub (not shown). A typical anchor-packer and connector sub are shown in related patent application Ser. No. 572,592, filed Dec. 14, 1995, incorporated herein by reference. The anchor-packer includes a plurality of slips adapted for biting engagement with the inside diameter of the wall of casing 14 to anchor whipstock assembly 20 within cased borehole 12 and a plurality of packing elements adapted for sealingly engaging the inside diameter of casing 14 to isolate the well bore 12 below the anchor-packer from a new deflection borehole located above the anchor-packer.

Whipstock 22 includes a mandrel-like body 24 with an upper tapered guide section or ramp 28 for guiding the milling assembly 30 into milling engagement with the wall of casing 14. The lower end of whipstock 22 includes threads for threading engagement with the connector sub. The whipstock assembly 20 also includes a fluid passageway 32 which extends from inlet port 34, disposed below the upper end of whipstock 22, down through the connector sub to the anchor-packer for hydraulically connecting the anchor-packer to the milling assembly 30. Fluid passageway 32 includes a bore extending through body 24 from the lower terminal end thereof to port 34 extending to the exterior thereof. A coupling 36 is provided at inlet 34 for connecting a high pressure hose 40 to a coupling 42 on the lower end of milling assembly 30. Milling assembly 30 provides fluid communication from coupling 42, through flowbore 92, to a drilling fluid supply (not shown) at the surface. This establishes a direct hydraulic communication between the surface and the anchor-packer so as to hydraulically set the slips and packing elements of the anchor-packer. Although a hydraulically actuated anchor-packer has been described, the anchor-packer may also be adapted to be mechanically set.

The tapered guide section 28 includes an elongated wedge or ramp surface 50 having a curved or arcuate cross section (not shown). See U.S. patent application Ser. No. 08/642,829 filed May 3, 1996, incorporated herein by reference. Ramp surface 50 extends from the upper terminal end 52 of whipstock 22 down to a lower barrel portion (not shown) of whipstock 22. The direction which the milling assembly 30 is guided out the side wall of casing 14 is controlled by the placement of whipstock 22 within the borehole 12 in a known orientation. The anchor-packer maintains the ramp surface 50 at the correct angle and direction relative to the casing 14 for the cutting of pilot or window 16.

The ramp surface 50 is preferably made of material that is harder than casing 14 but not as hard as the cutting elements of the mills, hereinafter described, on the milling assembly 30. If the ramp surface 50 were not harder than the metal of casing 14, the milling assembly 30 would mill into the whipstock 22 rather than milling the wall of casing 14. The milling assembly 30 is preferably pressed against the ramp surface 50 with a force greater than it is pressed against the casing 14 and the difference of hardness between the casing 14 and the ramp surface 50 must be sufficient to overcome this excess force. The ramp surface 50 may be comprised of an annealed, high performance steel so that the milling assembly 30 can be safely directed along the ramp surface 50 without damaging the whipstock 22. Further ramp surface 50 may include hardfacing to withstand the cutting of the milling assembly 30. One of the objectives of the present invention is to have the ability to remove and reuse the whipstock assembly 20.

The ramp surface 50 typically will include a tapered face having an angle of preferably 3° with the axis of whipstock 22. However, it should be appreciated that ramp surface 50 may have tapered faces with different angles for accomplishing particular purposes during the side cutting operation. See U.S. patent application Ser. No. 08/642,829 filed May 3, 1996, incorporated herein by reference.

The milling assembly 30 includes a plurality of cutting tools or mills namely a window mill 60, a pilot mill 62, and a watermelon mill 64. The window mill 60 includes a full diameter cutting surface 67 which is the major diameter of mill 60 and includes a lower tapered cutting surface 69 having a cutting taper from 0 to 45°. Other mills may be included in milling assembly 30 above watermelon mill 64. Mills 60, 62, and 64 have hard facing and include cutting elements, such as cutting elements 66 on window mill 60, which may be dressed with various materials such a carbide, ceramics, and/or diamonds. Mills 60, 62 and 64 are mounted on a tubular member 70 having a threaded box 72 at its upper end for threaded engagement with a work or drill string 74. Centralizers (not shown) may be provided on drill string 74 for centering the milling assembly 30 within the borehole 12. Tubular member 70 includes an upper rigid or stiff barrel portion 76 and a lower flexible portion 78. Lower flexible portion 78 has a reduced outer diameter forming a transition portion 80. Window mill 60 is mounted on the lower end of flexible portion 78 with pilot mill 62 also being disposed on flexible portion 78 above pilot mill 60. Watermelon mill 64 is disposed on rigid barrel portion 76 above transition portion 80.

Figure 3:
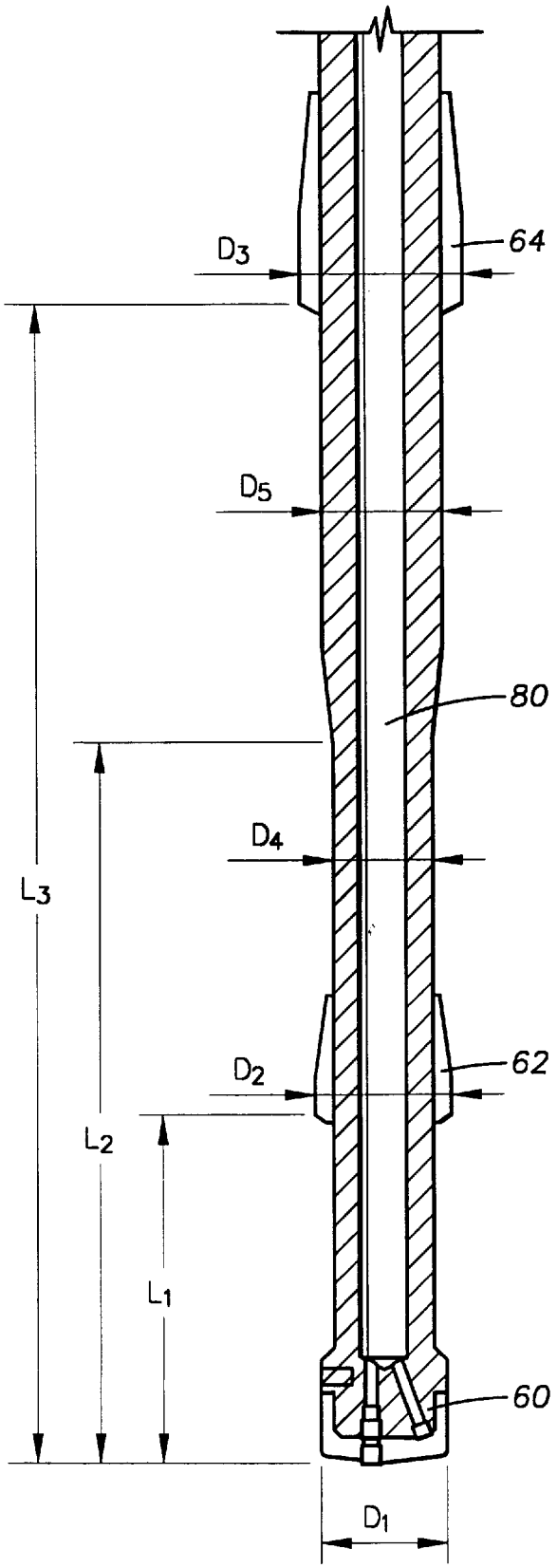
FIG. 3 is a schematic of the dimensions of the milling assembly.

FIG. 3 schematically depicts the lengths and diameters of the milling assembly 30. L1 represents the distance between the lower end of window mill 60 and the lower end of pilot mill 62, L2 represents the distance between the lower end of window mill 60 and the lower end of transition portion 80, and L3 represents the distance between the lower end window mill 60 and the lower end of watermelon mill 64. The mills 60, 62, and 64 have different cutting diameters, i.e. gauges. Preferably, watermelon mill 64 is substantially full gauge, pilot mill 62 is approximately 90% gauge, and window mill 60 is approximately 80% gauge. The relevant diameters include D1 which is the diameter of window mill 60, D2 is the diameter of pilot mill 62, and D3 is the diameter of watermelon mill 64. Further, D4 is the diameter of flexible portion 78 and D5 is the diameter of upper rigid portion 76. An ABHA bottom hole assembly program is described in U.S. patent application Ser. No. 572,592 filed Dec. 14, 1995, incorporated herein by reference.

The upper terminal end 52 of whipstock 22 includes a small wedge block 90 disposed on the ramp surface 50. Hard facing is placed on wedge block 90 to act as a bearing to point the milling assembly 30 in the proper direction. Hard facing is also placed on the back edge of window mill 60 which also acts as a bearing. The milling assembly 30 is releasably connected to whipstock assembly 20. A shear bolt 82 extends through an aperture 84 in the upper terminal end 52 of whipstock 22 for threaded engagement in a tapped bore 86 in the side of window mill 60. As previously described, window mill 60 also includes hydraulic coupling 42 for connecting hydraulic hose 40 to provide a hydraulic connection to the anchor-packer. The shear bolt 82 and hose 40 permit the setting and proper positioning of the whipstock assembly 20 within wellbore 12. Window mill 60 also includes another hydraulic port 88 communicating wellbore 12 below window mill 70 with flowbore 92. Port 88 includes a rupture disc 94 which ruptures at a predetermined pressure such as 3,000 to 3,300 psi. This allows for additional circulation to set the packer.

Figure 4:
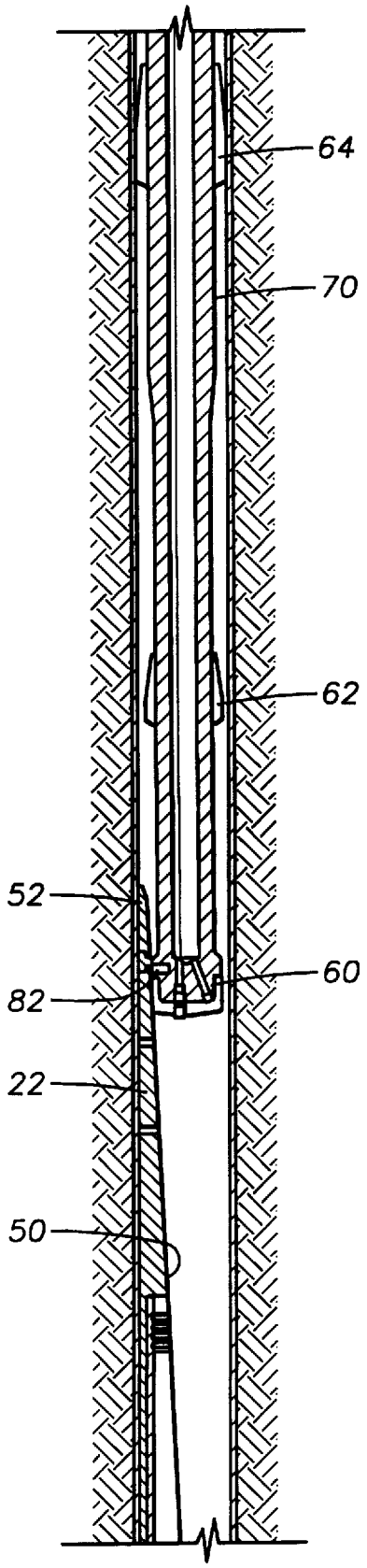
FIG. 4 is a partial cross-sectional elevation view of the milling and whipstock assembly of the present invention with the milling assembly having been detached from the whipstock assembly.

In operation, the whipstock assembly 20 and milling assembly 30 are connected on the lower end of drill string 74 and lowered into the wellbore 12 as shown in FIG. 1. Once the desired depth is reached for the secondary or deflection bore, the whipstock assembly 20 is aligned and oriented within the wellbore 12 and the anchor-packer is set via over pressure down hydraulic flowbore 92, hose 40, and bore 32 to set the slips and packing elements of the anchor-packer thereby anchoring the whipstock 20 within the cased wellbore 12 at the desired location and orientation. Weight is then placed on the drill string 74 to shear shear bolt 82 as shown in FIG. 4. The drill string 74 is then rotated to initiate the milling of the pilot window in casing 14.

Figure 5:
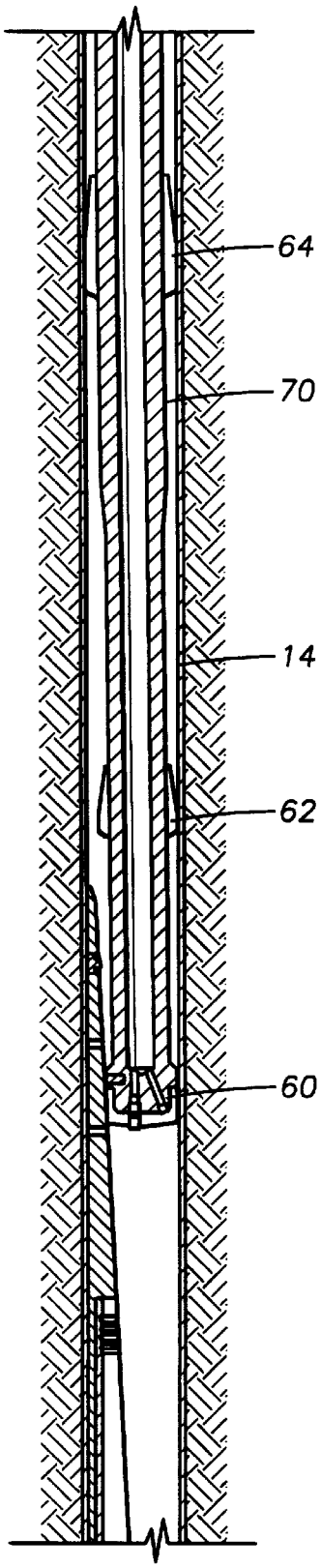
FIG. 5 is a partial cross-sectional elevation view of the milling and whipstock assembly of the present invention with the window mill engaging and milling the cased borehole.

Referring now to FIG. 5, the window mill 60 moves down ramp surface 50 on whipstock 22 directing window mill 60 in the proper direction for the side tracking operation. A hardened surface may be provided on ramp surface 50 to keep window mill 60 from milling into the whip 22. The initial guidance of the wedge block 90 ensures that whipstock 22 is not damaged by window mill 60 and that window mill 60 properly initiates the required pilot cut. It is important to deflect the window mill 60 away from the ramp surface 50 of the whipstock 22 to avoid the window mill 60 from milling the whipstock 22. Mills 60, 62 are substantially under gauge for proper geometry. By having the mills substantially under gauge, tubular member 70 points mills 60, 62 in the proper direction for cutting window 16 with reduced side loading forces to force mills 60, 62 in the proper direction and yet cut window 16. Window mill 60 and pilot mill 62 mounted on flex portion 78 engage casing 14 approximately at the same time such that upon placing weight on drill string 74, mills 60 and 62 are flexed approximately at transition portion 80 into casing 14. Although both mills 60, 62 begin cutting almost simultaneously, window mill 60 will begin to cut first. The full gauge mill 64 centralizes the rigid portion 76 of shaft 70 within casing 14. The forces which are generated through the pivoting of flexible tubular member 78 about full gauge watermelon mill 64 provide the geometry to angle mills 60, 62 into the proper direction so as to begin cutting window 16 in casing 14.

As milling assembly 30 is rotated and lowered on drill string 74, the wedge 90 on the upper end of ramp surface 50 cammingly and wedgingly forces window mill 60 against casing 14 thereby causing window mill 60 to kick out and force cutting elements 66 into milling engagement with casing 14. Almost simultaneously, pilot mill 62 also engages and begins to cut casing 14. As mills 60, 62 are rotated and moved downwardly, they continue to be deflected out against the wall of casing 14 and eventually punch through the casing wall.

Figure 6:
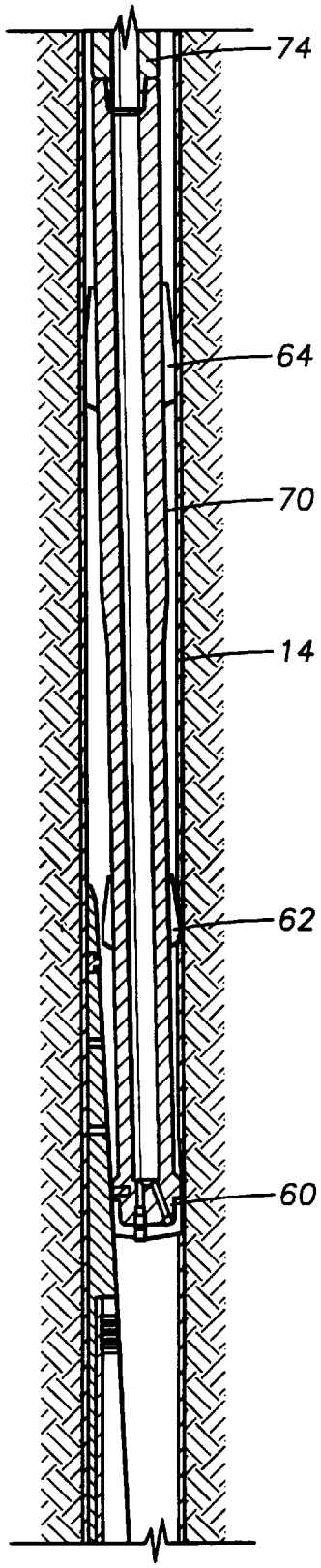
FIG. 6 is a partial cross-sectional elevation view of the milling and whipstock assembly of the present invention with the window mill having fully penetrated the casing.

Referring now to FIG. 6, window mill 60 and pilot mill 62 are shown cutting through casing 14. Once initial punch out has been achieved, little weight on drill string 74 is required to push milling assembly 30. It is the actual punch through of mill 60, 62 that is the most difficult cutting. Once mill 60, 62 punch through the casing walls a ledge is created allowing the whipstock 22 to then guide the milling assembly 30 through the pilot cut in the casing wall. Once the mills 60, 62 break through the wall of casing 14, very little side load is then required to maintain the deflection of the milling assembly 30.

Figure 7:
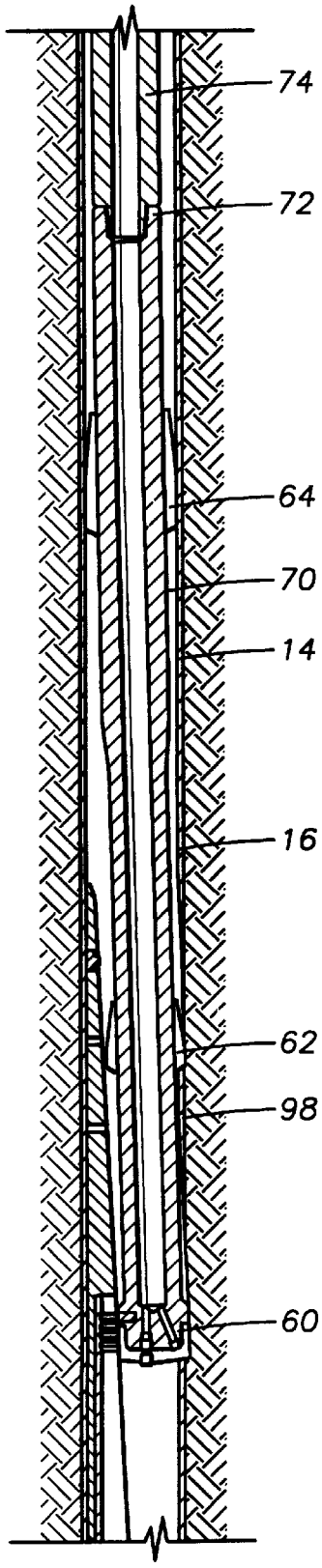
FIG. 7 is a partial cross-sectional elevation view of the milling and whipstock assembly of the present invention with the window mill and pilot mill having penetrated the casing.

FIG. 7 illustrates window mill 60 having cut through casing 14 and pilot mill 62 cutting the remaining section 98 of casing 14 which remains between the paths cut by mill 60, 62. Upon the window mill 60 passing outside the wall of casing 14, a side track is formed through the wall of casing 14 and a window borehole in the formation. The pilot is cut substantially the entire length of whipstock 22. Once the milling or cutting of the pilot 16 is completed, the drill string 74 and milling assembly 30 are replaced by a standard drilling apparatus for drilling the new borehole.

While a preferred embodiment of the invention has been shown and described, modifications thereof can be made by one skilled in the art without departing from the spirit of the invention.

What is claimed:

1. A side track cutting apparatus mounted on a pipe string for cutting a secondary borehole in an existing borehole, comprising:

a shaft having a rigid portion and a flexible portion;

a first cutting tool disposed on an end of said flexible portion;

a second cutting tool disposed on said rigid portion;

said flexible portion being continuous from said rigid portion to said first cutting tool; and said flexible portion flexing as said first cutting tool engages the existing borehole.

2. The apparatus of claim 1 wherein said rigid portion has a first diameter and said flexible portion has a second diameter smaller than said first diameter.

3. The apparatus of claim 1 wherein a transition portion is formed between said rigid portion and said flexible portion.

4. The apparatus of claim 1 wherein said first cutting tool is under gauge and said second cutting tool is substantially full gauge.

5. The apparatus of claim 1 further including a third cutting tool disposed on said flexible portion of said shaft between said first and second cutting tools.

6. The apparatus of claim 5 wherein said third cutting tool has a cutting gauge sized between that of said first and second cutting tools.

7. The apparatus of claim 1 wherein said flexible portion and said rigid portion are integral.

8. A side track cutting apparatus for cutting a secondary borehole in an existing borehole, comprising:

a milling assembly including a shaft with a stiff portion and a flexible portion, a first cutting tool mounted on an end of said flexible portion and a second cutting tool mounted on said stiff portion;

a whipstock having a ramp portion;

said first cutting tool releasably attached to one end of said whipstock;

said flexible portion flexing as said ramp portion places a side load on said first cutting tool; and said flexible portion having a length greater than twice its diameter.

9. The apparatus of claim 7 further including a bearing pad disposed between said first cutting tool and said ramp portion where said first cutting tool is attached to said whipstock.

10. The apparatus of claim 8 wherein said second cutting tool is substantially full gauge and therefore in engagement with said borehole causing said shaft to flex between said first and second cutting tools as said ramp portion forces said first cutting tool into the borehole.

11. A method of cutting a secondary borehole in a cased borehole comprising the steps of:

disposing a full gauge cutting tool on a shaft with an under gauge cutting tool on the end of the shaft;

placing a side load on the under gauge cutting tool; and flexing that portion of the shaft extending between the full gauge cutting tool and under gauge cutting tool.

* * * * *